US005094686A

United States Patent [19]

Kawakami et al.

[11] Patent Number: 5,094,686

[45] Date of Patent: Mar. 10, 1992

[54] PROCESS FOR PRODUCING COPPER FINE POWDER

[75] Inventors: Takamasa Kawakami; Satoru Makinose; Kazuhiro Ando, all of Ibaraki; Rieko Nakano, Niigata, all of Japan

[73] Assignee: Mitsubishi Gas Chemical Co., Inc., Tokyo, Japan

[21] Appl. No.: 580,675

[22] Filed: Sep. 11, 1990

[30] Foreign Application Priority Data

Sep. 12, 1989 [JP] Japan ..... 1-234735

[51] Int. Cl.[5] ..... B22F 9/30

[52] U.S. Cl. ..... 75/343; 75/373; 419/8

[58] Field of Search ..... 75/343, 373; 419/8

[56] References Cited

U.S. PATENT DOCUMENTS 3,177,077 4/1965 Eyraud et al. ..... 75/201

OTHER PUBLICATIONS

Khimchenko et al., Sov. Powder Met. & Met. Cer. 22 (5) 1983, p. 325.

Khimchenko et al. Sov. Powder Met. & Mer. Cer. 16 (5) 1977, p. 323.

Chemical Abstracts, vol. 87, No. 10, Oct. 5, 1977, Abstract No. 71967c.

*Primary Examiner*—Upendra Roy

*Attorney, Agent, or Firm*—Sughrue, Mion, Zinn, Macpeak & Seas

[57] ABSTRACT

A process for producing a copper fine powder, which comprises thermally decomposing anhydrous copper formate in a solid phase in a non-oxidizing atmosphere at a temperature in the range of from 150° to 300° C., thereby yielding a copper fine powder having a primary particle diameter of from 0.2 to 1 μm, a specific surface area of from 5 to 0.5 $m^2/g$ and small agglomerating properties, said anhydrous copper formate being an anhydrous copper formate powder 90 wt % or more of which undergoes thermal decomposition within a temperature range of from 160° to 200° C. when the anhydrous copper formate powder is heated in a nitrogen or hydrogen gas atmosphere at a heating rate of 3° C./min.

4 Claims, No Drawings

PROCESS FOR PRODUCING COPPER FINE POWDER

FIELD OF THE INVENTION

The present invention relates to a process for producing a novel copper fine powder comprising nearly spherical primary particles having an average particle diameter of from 0.2 to 1 μm, having a specific surface area of from 5 to 0.5 $m^2/g$, and having small agglomerating properties. The copper fine powder produced by the process of the present invention can be advantageously used in the purposes of use such as an electrically conductive filler for coating compositions, pastes, resins, or the like, an anti-bacteria additive, a raw powder for powder metallurgy, and others.

BACKGROUND OF THE INVENTION

Conventionally known methods for the manufacture of copper powders include an electrolytic method, an atomization method, mechanical pulverization, etc., and such copper powders produced by those methods are used mainly in powder metallurgy and the like. Although those methods which generally produce powders having relatively a large particle diameter have come to produce finer powders of copper by controlling the production conditions or by seiving, the production efficiency is low and the fineness attainable by those methods is limited.

For use in purposes such as coating compositions, pastes, and resins, on the other hand, copper powders are required to be composed of powder particles which are finer, i.e., 10 μm or less, and uniform in shape from the standpoints of uniform dispersion and uniform coating. For use in electronic parts, copper powders containing only a slight amount of alkali metals such as Na or K, sulfur, and halogens such as Cl are preferred mainly from the standpoint of preventing corrosion and electrical property deterioration due to moisture.

Copper fine powders for use in the above purposes are manufactured, for example, by the liquid-phase reduction precipitation of a copper compound, evaporation under vacuum or in an inert gas, the gas-phase reduction of a copper salt, and the solid-phase reduction of an oxide.

However, the liquid-phase reduction precipitation method is defective in performance and cost because the particle diameter distribution is wide, the reducing agent is expensive, and the process must be practiced batchwise. The evaporation under vacuum or in an inert gas is defective in that although copper powders which are extremely fine and have a large specific surface area can be obtained, the oxidation inhibition and handling of the copper powders are difficult, production facilities are costly and the mass productivity is poor. The gas-phase reduction of a copper salt, particularly a copper halide, which is carried out at high reaction temperatures, has problems such as the corrosion of the equipment by a halogen generated by the decomposition of the halide, troublesome collection of the powder produced, etc., and is also defective in that the halogen remains in a large amount in the copper powder produced. In practicing the solid-phase reduction of an oxide, it is essential that the starting material should be finely powdered and purified before use since the shape and purity of the copper powder to be produced depend on the starting material, and the particles should be prevented from agglomerating and growing due to their sufficient contact with the reducing gas and also due to heat generation accompanying the reduction. Thus, the solid-phase reduction method has been defective in that the production efficiency is low and control of the production conditions is difficult.

SUMMARY OF THE INVENTION

Under the above circumstances, the present inventors have made intensive studies to develop a process for producing a copper fine powder by simple procedures. As a result, they have found a process for producing a copper powder having an average primary particle diameter of 0.2 to 1 μm, a specific surface area of 5 to 0.5 $m^2/g$ and small agglomerating properties. The present invention has been completed based on the above.

Accordingly, an object of the present invention is to provide a process for producing a copper fine powder as described above.

The process for producing a copper fine powder according to the present invention comprises thermally decomposing anhydrous copper formate in a solid phase in a non-oxidizing atmosphere at a temperature in the range of from 150° to 300° C., thereby yielding a copper fine powder having an average primary particle diameter of from 0.2 to 1 μm, a specific surface area of from 5 to 0.5 $m^2/g$ and small agglomerating properties, the anhydrous copper formate being an anhydrous copper formate powder 90 wt. % or more of which undergoes thermal decomposition within a temperature range of from 160° to 200° C. when the anhydrous copper formate powder is heated in a nitrogen or hydrogen gas atmosphere at a heating rate of 3° C./min.

In preferred embodiments of the present invention, the copper fine powder obtained comprises agglomerates of copper fine powder primary particles, with the average diameter of the agglomerates being 10 μm or less; the anhydrous copper formate powder used as a raw material is 20 mesh or finer; the anhydrous copper formate powder is obtained by dehydrating copper formate hydrate at a temperature of 130° C. or less and then pulverizing the dehydrated copper formate; the anhydrous copper formate in a powder form is copper formate obtained by reacting at least one copper compound selected from the group consisting of copper carbonate, copper hydroxide, and copper oxide with formic acid or methyl formate; and the copper fine powder obtained by the above-described process is then washed with water, an organic solvent, or a solution of a rust inhibitor for copper in water or an organic solvent, to thereby diminish from the powder at least one impurity element selected from the group consisting of halogens, sulfur, alkali metals, and heavy metals to produce a purified copper fine powder.

DETAILED DESCRIPTION OF THE INVENTION

The process of the present invention is described in detail below.

The anhydrous copper formate used in the present invention generally is cupric formate. The anhydrous copper formate is an anhydrous copper formate powder which satisfies a thermal decomposition requirement that when the powder in an amount of 10 mg is heated in a nitrogen or hydrogen gas atmosphere at a heating rate of 3° C./min, 90 wt. % or more of the powder be thermally decomposed within a temperature range of from 160° to 200° C. This thermal decomposition behavior is preferable from the standpoint of obtaining a copper fine powder which has a higher purity and small agglomerating properties. The anhydrous copper formate powder preferably is a 20 mesh or finer powder, particularly a 100 mesh or finer powder, from the standpoint of yielding a copper powder having a smaller agglomerate particle size. Such anhydrous copper formate powder can be obtained by dehydrating copper formate hydrate at a temperature of 130° C. or lower and then pulverizing the dehydrated copper formate, obtained by forming crystals of anhydrous copper formate directly from an aqueous solution of copper formate and then pulverizing the crystals, or obtained by directly forming a 20 mesh or finer anhydrous copper formate crystalline powder from an aqueous solution of copper formate. It is preferred that the anhydrous copper formate powder thus produced has a low content of impurity elements, particularly alkali metals such as Na or K, sulfur, and halogens such as Cl, for the purpose of producing a copper fine powder having reduced impurity content.

Anhydrous copper formate produced by any of various methods can be used in the present invention so long as the copper formate to be used satisfies the above requirements. However, anhydrous copper formate produced by a method in which copper carbonate, copper hydroxide, or copper oxide is used as the raw copper compound and this raw copper compound is reacted with formic acid or methyl formate, is suitable as a raw material for the process of the present invention when the process is practiced industrially.

Since all of copper carbonate, copper hydroxide, and copper oxide, which are industrially obtained from cheaper copper salts or from waste copper, are substantially insoluble in water, those copper compounds obtained can easily be made to have a reduced content of such impurity elements as described above by subjecting the copper compounds to washing or other treatment before being dried. For example, in the case where copper sulfate is reacted with sodium carbonate or sodium hydrogen carbonate to produce copper carbonate, impurity elements ascribable to the raw compounds, such as Na and S, can be diminished from the copper carbonate by a method which comprises adding sodium carbonate or sodium hydrogen carbonate to an aqueous copper sulfate solution, allowing the reactants to react at a temperature of 60° to 85° C. to form a precipitate, and then washing the precipitate with water without drying it.

The order of the reactivity of the copper compounds described above with formic acid is: copper hydroxide > copper carbonate >> cuprous oxide, cupric oxide. A copper compound selected from those compounds is mixed with formic acid or methyl formate normally in an aqueous medium, the amount of the formic acid or methyl formate being not less than equivalent to the copper compound and being determined according to the kind of the copper compound. The resulting mixture is kept at a temperature between room temperature and 100° C. for 30 minutes to 24 hours to allow the reactants to undergo a liquid-phase reaction, thereby obtaining an aqueous solution of copper formate.

In the above method, the raw compounds may remain unreacted in the reaction system depending on the reaction conditions, by-products may be formed in addition to the copper formate, or the copper formate formed may further react to form other compounds. Thus, the copper formate produced contains such other compounds. For example, since copper formate is considerably unstable in an aqueous solution thereof, the larger the amount of the water and the higher the temperature, the more the formation of water-insoluble products by side reactions or successive decomposition reactions, such as basic copper formates, is accelerated. All of the unreacted raw compounds such as copper carbonate, copper hydroxide, and copper oxide and the products by side reactions or decomposition reactions, such as basic copper formates, can be converted through reduction to metallic copper without yielding any substance included in the copper. However, since the reduction reaction is accompanied by considerable heat generation and results in formation of water, those copper compounds are not suitable for solid-phase thermal decomposition in the process of the present invention because use of those compounds necessitates calorimetric control and other complicated procedures.

Thermal decomposition behaviors of those copper compounds were examined by differential thermal balance analysis in which copper hydroxide, basic copper carbonate, anhydrous copper formate, and a product of the successive decomposition reaction of copper formate, each weighing 10 mg, were heated in an $N_2$ or $H_2$ gas atmosphere at a heating rate of 3° C./min. The results obtained are shown in Table 1 with respect to the peak temperatures in calorimetric changes (endothermic or exothermic change or similar changes) and the decomposition products.

TABLE 1

| | Atmosphere | |
|---|---|---|
| | $N_2$ gas | $H_2$ gas |
| Copper hydroxide | 150–160° C. Endothermic; Oxide | 140–170° C. Exothermic; Copper powder |
| Basic copper carbonate monohydrate | 250–300° C. Endothermic; Oxide | 130–160° C. Exothermic; Copper powder |
| Anhydrous copper formate | 160–190° C. Slightly Endothermic; Copper powder | 170–200° C. Slightly Exothermic; Copper powder |
| Decomposition product of copper formate | 200–210° C. Exothermic; Oxide containing copper | 200–220° C. Exothermic; Copper powder |

Table 1 shows that all of the copper compounds other than anhydrous copper formate decompose in a nitrogen ($N_2$ gas) atmosphere to give copper oxide or a powder mainly comprising of copper oxide, and that the decomposition of those copper compounds is endothermic or exothermic. The calorimetric changes of those copper compounds are at least 10 times that of anhydrous copper formate, and in particular, the endothermic change of basic copper carbonate monohydrate which contains water of crystallization, is about 100 times that of anhydrous copper formate.

Further, all of the copper compounds, except for anhydrous copper formate, are required to be heated in a reducing atmosphere ($H_2$ gas) for the formation of metallic copper powder, and their reactions in the reducing atmosphere are exothermic, with the amounts of their exothermic heat being at least 5 times that of anhydrous copper formate.

Table 1 further shows that the decomposition peak temperatures for the copper compounds other than anhydrous copper formate and that for anhydrous copper formate are substantially different, although some of the former slightly overlap with the latter.

From the above, it can be understood that anhydrous copper formate can easily be thermally decomposed at predetermined temperatures to form a copper powder without undergoing calorimetric changes. The following can also be understood. In the case where anhydrous copper formate is contaminated with those copper compounds, metallic copper is formed by the reducing power of decomposed formic acid. However, if the amount of the compounds other than anhydrous copper formate is too large, the amount of exothermic heat accompanying the reduction reactions becomes too large and, as a result, the copper fine powder particles formed strongly agglomerate with each other due to local heating etc., so that a copper fine powder is difficult to obtain. If the amount of those compounds is even more large, the copper powder produced becomes a copper powder containing copper oxide therein.

Therefore, the anhydrous copper formate used in the present invention preferably is one having a low content of those compounds other than copper formate. A practical measure of this is that when a sample of anhydrous copper formate in an amount of 10 mg is heated in a nitrogen or hydrogen gas atmosphere at a heating rate of 3° C./min, 90 wt. % or more of the sample is thermally decomposed within a temperature range of from 160° to 200° C. It is preferred that the above be taken into account when the anhydrous copper formate is synthesized industrially for use in this invention.

In the process of the present invention, a powder of anhydrous copper formate described above is thermally decomposed in a solid phase to produce a copper fine powder.

The thermal decomposition of anhydrous copper formate is carried out in a solid phase in a non-oxidizing atmosphere normally under ordinary pressure at a temperature in the range of from 150° to 300° C., preferably from 160° to 250° C. The process can be practiced batchwise with the anhydrous copper formate being packed in a box, can, or other vessel and heated to and kept at a predetermined temperature. Alternatively, the process can be practiced in a continuous manner in which the anhydrous copper formate is placed on a continuous transferring means such as a belt, and the transferring means continuously transfers the copper formate to a heating zone heated to a predetermined temperature, where the copper formate is thermally decomposed, and the decomposition product is then withdrawn.

In the present invention, the anhydrous copper formate powder in a solid phase means an anhydrous copper formate powder packed in a box-type or similar vessel made of a material which withstands the heating temperature and is not attacked by formic acid vapor, an anhydrous copper formate powder placed on a continuous belt made of such a material, or an anhydrous copper formate powder in a similar state. The amount of the anhydrous copper formate powder packed in a vessel or placed on a belt is not particularly limited because the relationship between the amount of the copper formate powder and the agglomerate-forming properties of the copper fine powder obtained is slight. However, the anhydrous copper formate powder is generally used in an amount such that the inner part of the anhydrous copper formate can be completely decomposed within a desired period of time, for example, from several minutes to several hours. The non-oxidizing atmosphere means an atmosphere of $N_2$, $H_2$, $CO_2$, CO, Ar, or other non-oxidizing gas, or an atmosphere of a gas formed by the decomposition of the anhydrous copper formate. In a preferred batch process, the decomposition atmosphere is made to be completely filled with the gas resulting from the decomposition of the copper formate powder by, for example, making the volume of the heating zone small. In a preferred continuous process, the same effect is attained by making the open spaces of the inlet to and outlet from the heating zone small. These modifications are advantageous because they eliminate the necessity of providing beforehand a system for creating an $N_2$, $H_2$, or other non-oxidizing gas atmosphere.

In the above-described thermal decomposition process of the present invention, thermal decomposition takes place successively from the outer part of the anhydrous copper formate to the inner part thereof. The copper powder formed by decomposition reaches, in a short period of time, the predetermined temperature at which the atmosphere is kept for the decomposition, because of the excellent thermal conductivity of copper powder, and the copper powder -is then exposed at that temperature to copper formate vapor (cuprous formate) generated from undecomposed copper formate and also to formic acid gas formed by decomposition and gases of decomposition products of the formic acid. Thus, a copper powder formed in the initial stage of the process is kept being exposed to these gases at the predetermined temperature throughout the thermal decomposition. If the thermal decomposition temperature exceeds 300° C., the copper powder disadvantageously tends to form agglomerates, and secondary decomposition, i.e., decomposition of formic acid formed by the decomposition of the anhydrous copper formate, tends to take place, unfavorably resulting in formation of water. However, if substantially all of the anhydrous copper formate has been decomposed, the temperature of the atmosphere can be increased above 300° C. as long as the period of exposure to such a high temperature is short, because even if the copper powder is subjected, for a limited period of time, to a temperature higher than 300° C., the powder's property of forming agglomerates is not enhanced so much. On the other hand, if the thermal decomposition temperature is below 150° C, the decomposition disadvantageously proceeds at an insufficient rate and takes much time. The more preferred range of the thermal decomposition temperature is from 160° to 250° C., this range being positioned near the lower limit of the 150°-300° C. range.

The copper powder produced by the above-described process of the present invention generally is a copper fine powder having an average primary particle diameter of from 0.2 to 1 μm, a specific surface area of from 5 to 0.5 $m^2/g$ and small agglomerating properties. The great feature of the copper fine powder obtained by the thermal decomposition of anhydrous copper formate according to the present invention is that the powder has weak agglomerating properties as compared with the copper powders produced by the reduction process and other conventional processes.

In comparison with the copper powders obtained by the reduction process and the like, the copper fine powder produced by the process of the present invention is more slowly oxidized in air. Therefore, even if the copper fine powder according to the present invention is left in air, it does not undergo color change due to oxidation, provided that the exposure period is short. It is preferred that since the copper fine powder produced contains impurity elements which were originally contained in the raw anhydrous copper formate powder and most of which are adhering to the surfaces of the powder particles, the copper fine powder be washed with water, an organic solvent, or a solution of a rust inhibitor for copper in water or an organic solvent to diminish the impurity elements such as halogens, sulfur, alkali metals, and heavy metals. By such a washing treatment, 90 wt. % or more of the alkali metals and halogens, for example, present as impurity elements can be removed, although depending on the amount of those impurity elements.

In a preferred washing treatment, water or an organic solvent such as an alcohol, each containing a rust inhibitor or the like, is used as a washing liquid in a single-stage washing or at the final stage in a multi-stage washing, and during the washing, an ultrasonic dispersing treatment, a dispersing treatment with a mixer, or the like is conducted. This method is advantageous in that diminution of impurity elements, rust-inhibiting treatment, and redispersion of agglomerated particles can be done.

As apparent from the above description and as will be demonstrated by the following Examples and Comparative Examples, the process for producing a copper fine powder through the thermal decomposition of anhydrous copper formate according to the present invention can provide a copper fine powder having a small primary particle diameter and small agglomerating properties, due to the use of the specific anhydrous copper formate. This specific anhydrous copper formate can be easily produced industrially at low cost from a more inexpensive copper compound, and in this case, impurities contained in the raw material can be easily diminished.

Therefore, the present invention, which provides a practical and novel process for the industrial production of a copper fine powder, is of considerable significance.

The present invention will be explained in more detail by reference to the following Examples and Comparative Examples, but the Examples should not be construed to be limiting the scope of the invention. In these examples, all parts and percents are by weight unless otherwise indicated.

EXAMPLE 1

To 1 kg of basic copper carbonate ($=CuCO_3 \cdot Cu(OH)_2 \cdot H_2O$) was added 2.4 kg of a 40% aqueous solution of formic acid. The resulting mixture was heated to 80° C. and maintained at this temperature for 30 minutes, while stirring the mixture. The water was then removed by evaporation at 80° C. under reduced pressure to concentrate and dry the reaction product, thereby obtaining 1.28 kg of crystals of anhydrous copper formate. The thermal decomposition properties of this anhydrous, copper formate was examined by heating 10 mg of the anhydrous copper formate in a nitrogen or hydrogen gas atmosphere at a heating rate of 3° C./min. As a result, the content of components that had decomposed within a temperature range of from 160° to 200° C. (hereinafter, referred to as "thermal decomposition property") was found to be substantially 100%.

The crystals of anhydrous copper formate obtained above were pulverized to a 100 mesh or finer powder, and 1 kg of the powder was packed in a box measuring 15 cm×15 cm33 8 cm (height). This box was placed in a nitrogen-replaced electric oven having a capacity of 3 liters. The temperature in the electric oven was elevated at a rate of 4° C./min and then the temperature was kept at 200° C. for 1.5 hours to carry out thermal decomposition. After the electric oven was allowed to cool to room temperature, the box was taken out to obtain 414 g of a thermal decomposition product powder showing a copper color.

This powder was a copper fine powder having an oxygen content of 0.4% or less, consisting of nearly spherical primary particles that were uniform in size and had an average particle diameter of about 0.3 μm, and having a specific surface area of 3 $m^2/g$.

To 0.1 g of the copper fine powder obtained above were added 0.3 g of a surfactant (Sorbitan fatty acid ester, "LEODOL", a product of Kao Corporation) and 150 g of water, and this mixture was subjected to ultrasonic dispersing treatment. Thereafter, the resulting dispersion was analyzed for agglomerate particle diameter by means of a laser-type particle size distribution analyzer. As a result, the agglomerate particle diameter (average) was found to be about 3 μm.

EXAMPLE 2

Anhydrous copper formate crystals were obtained in an amount of 1.28 kg in the same manner as in Example 1 except that 0.66 kg of cupric oxide powder and 2.4 kg of 80% aqueous formic acid solution were used as raw materials and that the raw materials were mixed and stirred at 80° C. for 20 hours. The thermal decomposition property of the thus-obtained anhydrous copper formate was substantially 100%.

The crystals of anhydrous copper formate obtained above were pulverized to a 100 mesh or finer powder, and using 1 kg of the powder, thermal decomposition was carried out in the same manner as in Example 1 except that the powder was kept at 300° C. for 1 hour. Thus, 414 g of a thermal decomposition product powder was obtained.

This powder was a copper fine powder consisting of nearly spherical primary particles that were uniform in size and had an average particle diameter of about 0.4 μm, and having a specific surface area of 2 $m^2/g$. The agglomerate particle diameter (average) of the powder was measured after the powder was dispersed in water by treatment with a mixer, and it was found to be about 8 μm.

COMPARATIVE EXAMPLE 1

To 0.66 kg of cupric oxide powder was added 2.4 kg of a 16% aqueous solution of formic acid. The resulting mixture was heated at 80° C. for 3 hours, and the water was then removed by evaporation at 100° C. under reduced pressure to concentrate and dry the reaction product, thereby obtaining 1.2 kg of crystals of anhydrous copper formate. The thermal decomposition property of this anhydrous copper formate was 85%. Crystals thus obtained were dissolved in water to determine the content of water-insoluble components, and the content was found to be 15%. The water-insoluble components were analyzed by X-ray diffractometry, and were found to have a composition corresponding to that of an approximately 1:1 mixture of unreacted cupric oxide and basic copper formate.

The anhydrous copper formate crystals obtained above were subjected to thermal decomposition in the same manner as in Example 2, and then cooled to room temperature.

The thermal decomposition product powder thus obtained showed a brown color, had an oxygen content of about 3%, and consisted of uniformly nearly spherical primary particles having an average particle diameter of about 0.3 μm. The agglomerate particle diameter (average) of the powder was measured after the powder was dispersed in water by treatment with a mixer, and it was found to be about 15 μm.

COMPARATIVE EXAMPLE 2

Using the same anhydrous copper formate powder as used in Comparative Example 1, thermal decomposition was conducted in the same manner as in Comparative Example 1 except that the thermal decomposition was effected while hydrogen gas was kept being introduced into the vessel containing the raw material.

The thermal decomposition product powder thus obtained showed a copper color and consisted of uniformly nearly spherical primary particles having an average particle diameter of about 0.3 μm. However, the powder turned brown in a relatively short period of time. Further, the agglomerate particle diameter (average) of the powder was measured after the powder was dispersed in water by treatment with a mixer, and it was found to be about 20 μm.

EXAMPLES 3 AND 4 AND COMPARATIVE EXAMPLES 3 AND 4

To 1.62 kg of copper hydroxide powder was added 4.8 kg of a 80% aqueous solution of formic acid, and this mixture was stirred for 1 hour. Upon filtration of the resulting mixture, copper formate tetrahydrate was obtained, which was then dehydrated at 100° C. under vacuum to obtain anhydrous copper formate.

Using the above-obtained anhydrous copper formate, copper powders were obtained in accordance with the same manner as in Example 1 except that the powder particle size and thermal decomposition conditions for each raw powder were as shown in Table 2. The results obtained are shown in Table 2.

TABLE 2

| | Example 3 | Comp. Example 3 | Comp. Example 4 | Example 4 |
|---|---|---|---|---|
| Particle size of anhydrous copper formate (mesh) | <100 | >10 | <20 | <20 |
| Thermal decomposition conditions | | | | |
| Temperature (°C.) | 300 | 300 | 200 | 400 |
| Period (Hr) | 1 | 1 | 2 | 1 |
| Copper powder produced | 0.4 | 0.6 | 0.4 | 1.5 |
| Primary particle diameter (μm) | | | | |
| Specific surface area ($m^2/g$) | 1.8 | 0.7 | 1.5 | 0.4 |
| Agglomerate particle diameter (μm) | 9 | 20 | 9 | 30 |

EXAMPLE 5

Five finds of anhydrous copper formates each having impurity contents as shown in Table 3 were obtained in the same manner as in Example 1 except that basic copper carbonates different in Na, Cl, and S contents were used as raw material. The anhydrous copper formates were thermally decomposed in the same manner as in Example 1 to obtain copper powders.

Each of the copper powders thus obtained was washed in the manner as shown in Table 3 to obtain a copper powder having greatly improved purity. The results obtained are shown in Table 3.

TABLE 3

| | 1 | 2 | 3 | 4 | 5 |
|---|---|---|---|---|---|
| Impurities in anhydrous copper copper formate (ppm) | | | | | |
| Na | 560 | 230 | 230 | 230 | 860 |
| Cl | 45 | 4 | 4 | 4 | 65 |
| S | 1 | 30 | 30 | 30 | 90 |
| Impurities in copper powder produced (ppm) | | | | | |
| Na | 1300 | 540 | 540 | 540 | 2000 |
| Cl | 100 | 8 | 8 | 8 | 150 |
| S | 2 | 70 | 70 | 70 | 200 |
| Washing liquids and procedure | 1*→4 | 1*→4 | 1*→2 X3 →4 | 3→4 | 1*→4 |
| Impurities in washed copper powder (ppm) | | | | | |
| Na | 50 | 20 | 10 | 75 | 270 |
| Cl | 2 | <1 | <1 | <1 | 2 |
| S | <1 | 1 | <1 | <1 | 3 |

The washing liquids and procedure for each copper powder as shown in Table 3 are as follows.

Washing Liquids

1: 0.5% Benzotriazole solution in water.
2: Water.
3: 0.5% Benzotriazole solution in methanol.
4: Methanol.

Washing Procedure

For one washing operation, 100 ml of a washing liquid was used per 20 g of copper powder and stirring or ultrasonic treatment (shown by *) was performed for 10 minutes. In the case where a washing operation was repeated, the number of the repeated washing operations is shown with "×" in the table (e.g., "×9" means "washed 9 times").

While the invention has been described in detail and with reference to specific embodiments thereof, it will be apparent to one skilled in the art that various changes and modifications can be made therein without departing from the spirit and scope thereof.

What is claimed is:

1. A process for producing a copper fine powder, which comprises:

introducing anhydrous copper formate powder into a non-oxidizing atmosphere, said anhydrous copper formate powder having a size of 20 mesh or finer;

thermally decomposing said anhydrous copper formate to yield the copper fine powder; and cooling the copper fine powder, wherein said thermally decomposing of said anhydrous copper formate is while the anhydrous copper formate powder is in a solid phase in a non-oxidizing atmosphere at a temperature in the range of from 150° to 150° C., thereby yielding said copper fine powder having a primary particle diameter of from 0.2 to 1 μm, a specific surface area of from 5 to 0.5 $m^2/g$ and small agglomerating properties, said anhydrous copper formate being an anhydrous copper formate powder 90 wt. % or more of which undergoes thermal decomposition within a temperature range of from 160° to 200° C. when the anhydrous copper formate powder is heated in a nitrogen or hydrogen gas atmosphere at a heating rate of 3° C./min, said anhydrous copper formate powder being obtained by dehydrating copper formate hydrate at a temperature of 130° C. or less and then pulverizing the dehydrated copper formate to yield said anhydrous copper formate powder, or obtained by reacting at least one copper compound selected from the group consisting of copper carbonate, cooper hydroxide, and copper oxide with formic acid or methyl formate to yield said anhydrous copper formate powder.

2. A process as claimed in claim 1, wherein said copper fine powder comprises agglomerates of copper fine powder primary particles, the diameter of said agglomerates being 10 μm or less.

3. A process for producing a purified copper fine powder, which comprises washing the copper fine powder obtained by the process as claimed in claim 1 with water, an organic solvent, or a solution of a rust inhibitor for copper in water or an organic solvent, thereby to diminish from said powder at least one impurity element selected from the group consisting of halogens, sulfur, alkali metals, and heavy metals.

4. A process as claimed in claim 1, wherein the amount of anhydrous copper formate constituting the solid phase is about 1 kg or more.

* * * * *